US008643588B2

(12) United States Patent
Chan

(10) Patent No.: US 8,643,588 B2
(45) Date of Patent: Feb. 4, 2014

(54) DISPLAY DEVICE AND CONTROL METHOD THEREOF

(75) Inventor: Yi-Chi Chan, Taipei Hsien (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 1087 days.

(21) Appl. No.: 12/534,795

(22) Filed: Aug. 3, 2009

(65) Prior Publication Data

US 2010/0164999 A1 Jul. 1, 2010

(30) Foreign Application Priority Data

Dec. 30, 2008 (CN) ..... 2008 1 0306671

(51) Int. Cl.
*G09G 3/36* (2006.01)

(52) U.S. Cl.
USPC ..... 345/102

(58) Field of Classification Search
USPC ..... 345/77, 690, 87–111; 349/40–50
See application file for complete search history.

(56) References Cited

U.S. PATENT DOCUMENTS

| | | | | |
|---|---|---|---|---|
| 7,102,696 | B2 * | 9/2006 | Kao et al. | 348/674 |
| 7,138,970 | B2 | 11/2006 | Krohn | |
| 8,044,977 | B2 * | 10/2011 | Lee et al. | 345/690 |
| 2002/0119806 | A1 * | 8/2002 | Yamaoka et al. | 455/566 |
| 2005/0140640 | A1 * | 6/2005 | Oh et al. | 345/102 |
| 2008/0224977 | A1 * | 9/2008 | Park et al. | 345/89 |
| 2008/0252794 | A1 | 10/2008 | Su et al. | |
| 2008/0258637 | A1 | 10/2008 | Leung | |
| 2009/0085862 | A1 * | 4/2009 | Takaku et al. | 345/102 |
| 2009/0128583 | A1 * | 5/2009 | Choi | 345/690 |
| 2009/0243986 | A1 * | 10/2009 | Jung | 345/94 |
| 2010/0053136 | A1 | 3/2010 | Ohta et al. | |
| 2010/0091039 | A1 * | 4/2010 | Marcu et al. | 345/690 |

FOREIGN PATENT DOCUMENTS

| | | | |
|---|---|---|---|
| CN | 1873772 | | 12/2006 |
| CN | 101291558 | A | 10/2008 |
| TW | 200841748 | | 10/2008 |
| WO | 2008/068920 | A1 | 6/2008 |

* cited by examiner

*Primary Examiner* — Chanh Nguyen
*Assistant Examiner* — Pegeman Karimi
(74) *Attorney, Agent, or Firm* — Altis & Wispro Law Group, Inc.

(57) ABSTRACT

A display device includes a display module for displaying information, a light module for emitting light to the display module, and a display control system. The display control system includes a storage module for storing display control parameters, and a system controller for setting the display module by using the display control parameters when an operation time of the light module equals to a predetermined time point, to compensate for a brightness deterioration of the light module. A related display control method is also provided.

16 Claims, 7 Drawing Sheets

DISPLAY DEVICE AND CONTROL METHOD THEREOF

BACKGROUND

1. Field of the Invention

The present disclosure relates to display devices, and particularly to an electronic display device and display control method of the electronic display device.

2. Description of Related Art

Various electronic display devices are widely used in modern lives. Common applications for electronic display devices (display devices in short) are television sets or computer monitors. Various light sources, such as incandescent light bulbs, light-emitting diodes (LEDs), electroluminescent panels (ELPs), cold cathode fluorescent lamps (CCFLs), and hot cathode fluorescent lamps (HCFLs), are used to provide light for the display devices, so that viewers will be able to use the display devices even in total darkness. However, most light sources have an inherent operational characteristic of gradually losing their relative brightness levels during their service lives. As a result, display property of the display devices decays. When the luminosity of the light sources decay to an unacceptable level, information displayed by the display devices may look illegible and incorrect, thus the light source need to be repaired or replaced.

Therefore, an improved display device with a light module having an extended service life is needed to address the aforementioned deficiency and inadequacies. A display control method for the display device to extend service life of the light module is also needed.

DETAILED DESCRIPTION OF CERTAIN INVENTIVE EMBODIMENTS

Reference will now be made to the drawings to describe certain inventive embodiments of the present disclosure.

Figure 1:
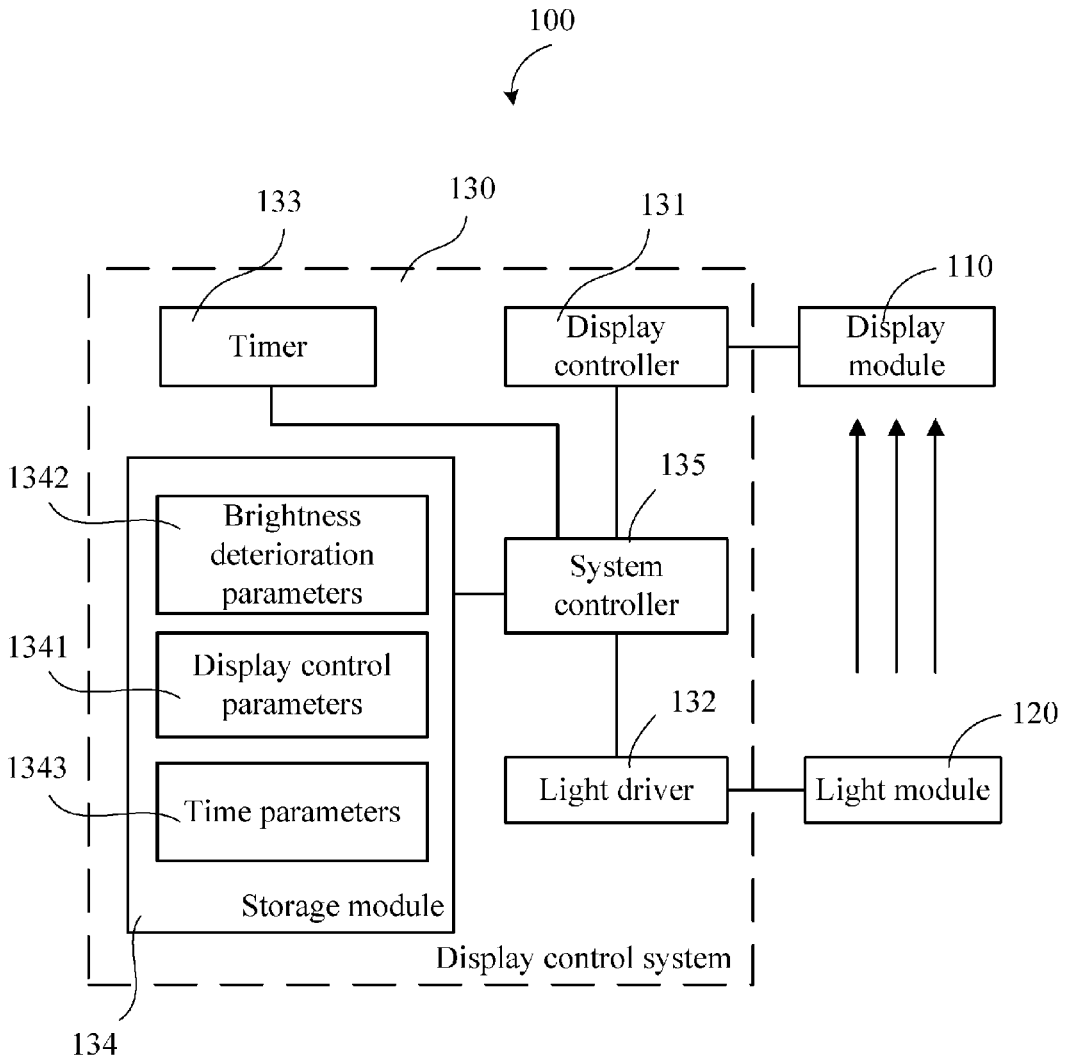
FIG. 1 is a block diagram showing an electronic display device in accordance with a first exemplary embodiment.

Referring to FIG. 1, a first electronic display device (hereinafter display device in short) 100 in accordance with a first exemplary embodiment is shown. The first display device 100 may include a display module 110, a light module 120, and a display control system 130. The first display device 100 may be a television (TV) set, or a computer monitor. The display module 110 may be a screen of the first display device 100, and is used for displaying information.

Figure 2:
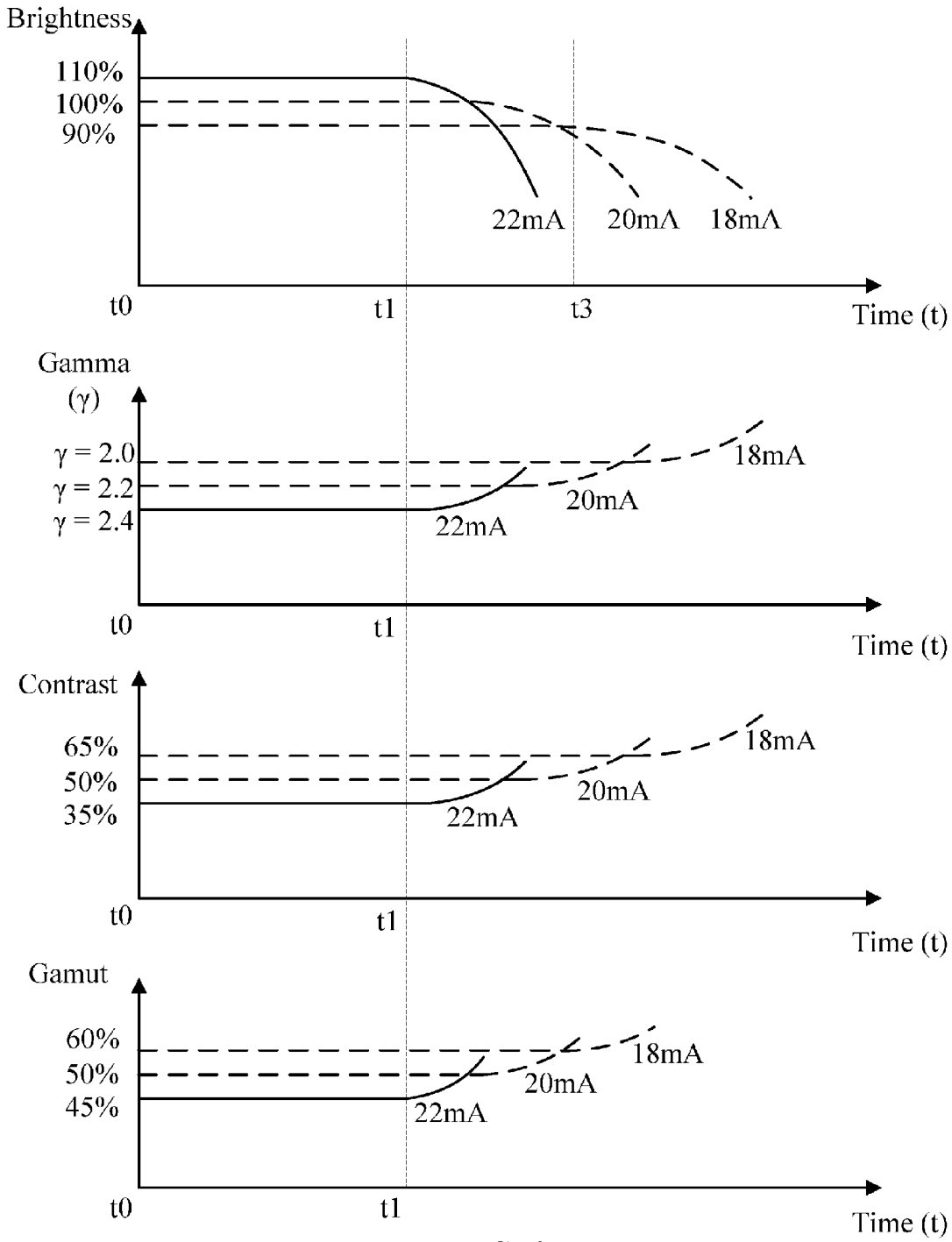
FIG. 2 is a graphical plot showing brightness parameters, gamma parameters, luminance contrasts parameters, color gamut parameters, of the display device of FIG. 1, as functions of operation time, respectively under the same current level in accordance with a first exemplary embodiment.

The light module 120 may be a backlight of the first display device 100, and is used for emitting light to the display module 110. The light module 120 may include a plurality of light sources of the same type, such as white light-emitting diodes (LEDs). These light sources have an inherent operational characteristic of gradually losing brightness over the course of their work/service lives. Referring also to FIG. 2, the three curves of brightness, as a function of time (operation time of the light module 120), depict brightness deteriorations of the light module 120 when operated under three different current levels. The three curves of the brightness versus time may be obtained by experiment. In general, each curve of the brightness versus time includes two stages, i.e., a constant stage and a decay/decrease stage. It is clear from FIG. 2, when the light module 120 operates with/under a higher current level, 22 milliamperes (mA) for example, the onset of the brightness deterioration occurs at an earlier time. That is, the higher the operation current is, the shorter the service life of the light module 120.

In this embodiment, at the constant stage, the brightness of the light module 120 remains constant over a predetermined time interval. For example, when operating at 22 mA, the predetermined time interval starts from a time point t0 and ends at a time point t1. When operating at 18 mA, the predetermined time interval starts from the time interval point t0 and ends at a time point t3. At the decaying/decreasing stage, the brightness of the light module 120 starts to decay at the time point t1 (maybe 20,000 hours) when operating at 22 mA, and starts to decay at the time point t3 (maybe 30,000 hours) when operating at 18 mA. The brightness considered to be the most preferred to viewers is when the light module 120 operates at 20 mA, because this is the most favorable viewing condition it is considered as 100%. When the light module 120 operates at 22 mA, the brightness is considered as 110%, and considered as 90% when the light module 120 operates at 18 mA.

Referring to FIG. 1, the display control system 130 is configured for controlling the display module 110 and the light module 120. The display control system 130 may include a display controller 131, a light driver 132, a timer 133, a storage module 134, and a system controller 135. The display controller 131 is used for adjusting various display control parameters of the display module 110 so as to obtain a proper display property. The light driver 132 is configured for powering the light sources of the light module 120 with predetermined operation currents and/or predetermined operation voltages, so as to adjust the brightness of the light module 120. The timer 133 measures/tracks the operation time of the light module 120. It is easily understandably that the operation time is an accumulative total operation time.

The storage module 134 may include a memory component, such as a random access memory (RAM), a dynamic random access memory (DRAM), a static random access memory (SRAM), a synchronous dynamic random access memory (SRAM), a ferroelectric random access memory (FRAM), a read only memory (ROM), a programmable read only memory (PROM), an erasable programmable read only memory (EPROM), an electrically erasable programmable read only memory (EEPROM), and/or a flash memory. The storage module 134 may have a first unit 1341 for storing the display control parameters. The display control parameters are used to adjust the display property of the display module 110. In this embodiment, the display control parameters include gamma, luminance contrast (contrast in short), and color gamut (gamut in short). Referring to FIG. 2, the curves of gamma, contrast, and gamut, as functions of time (the operation time), depict their respective changes corresponding to the three curves of brightness (in other words, corresponding to different operation currents). Specifically, each of the curves of gamma, contrast, and gamut includes a constant stage corresponding to the constant stage of the curve of brightness, and an increasing stage corresponding to the decaying/decreasing stage of the curve of brightness. The changes of the display control parameters are used to compensate for the brightness deterioration so as to maintain a stable display property.

The storage module 134 may also have a second unit 1342 for storing brightness deterioration parameters, depicted by the curves of brightness, as a function of time, as illustrated in FIG. 2. The system controller 135 may read the brightness of the light module 120 by searching the brightness deterioration parameters. The storage module 134 may also have a third unit 1343 for storing time parameters. The time parameters include time points, such as t1 in FIG. 2. The time points are used to indicate the system controller 135 to adjust the display module 110 by using the display control parameters.

The system controller 135 controls the display controller 131 and the light driver 132 according to the operation time (obtained from the timer 133), the display control parameters, and the time parameters.

Hereinafter, a display control parameter setting process of the first display device 100 will be described in detail.

The system controller 135 firstly determines the operation current of the light module 120, by detecting/reading an output current of the light driver 132 for example. The operation current may be set by users, or assigned default values. Supposing the operation current is 22 mA, the brightness (if normal) of the light module 120 is 110%, and in the embodiment, the original values of the display control parameters are assigned default values: the gamma is 2.4, the contrast is 35%, and the gamut is 45% correspondingly.

The system controller 135 receives operation time of the light module 120 from the timer 133, and determines whether the operation time has reached the time point t1. In this embodiment, the time point t1 is included in the time parameters stored in the third unit 1343. In this embodiment, in response to the determination that the time point t1 has been reached, the system controller 135 controls the display controller 131 to increase the gamut after the operation time reaches the time point t1, increase contrast and decrease the gamma a period of time after t1 to compensate for the brightness deterioration. Thus, maintaining/achieving a stable display property of the display module 110. In another perspective, the service life of the light module 120 is extended.

In other embodiment, the original values of the display control parameters may also be set by the users, and the system controller 135 needs to determine the current display control parameters besides the operation current, by checking or requesting the display controller 231 for example. When the operation time reaches a first predetermined time point, at which the brightness of the light module 120 starts to decay, the system controller 135 controls the display controller 131 to reset the display control parameters regularly in accordance with a predetermined rule similarly to that in the first embodiment, so as to compensate for the brightness deterioration. In doing so, the resetting of the display control parameters is more acceptable and friendly to the users.

Figure 3:
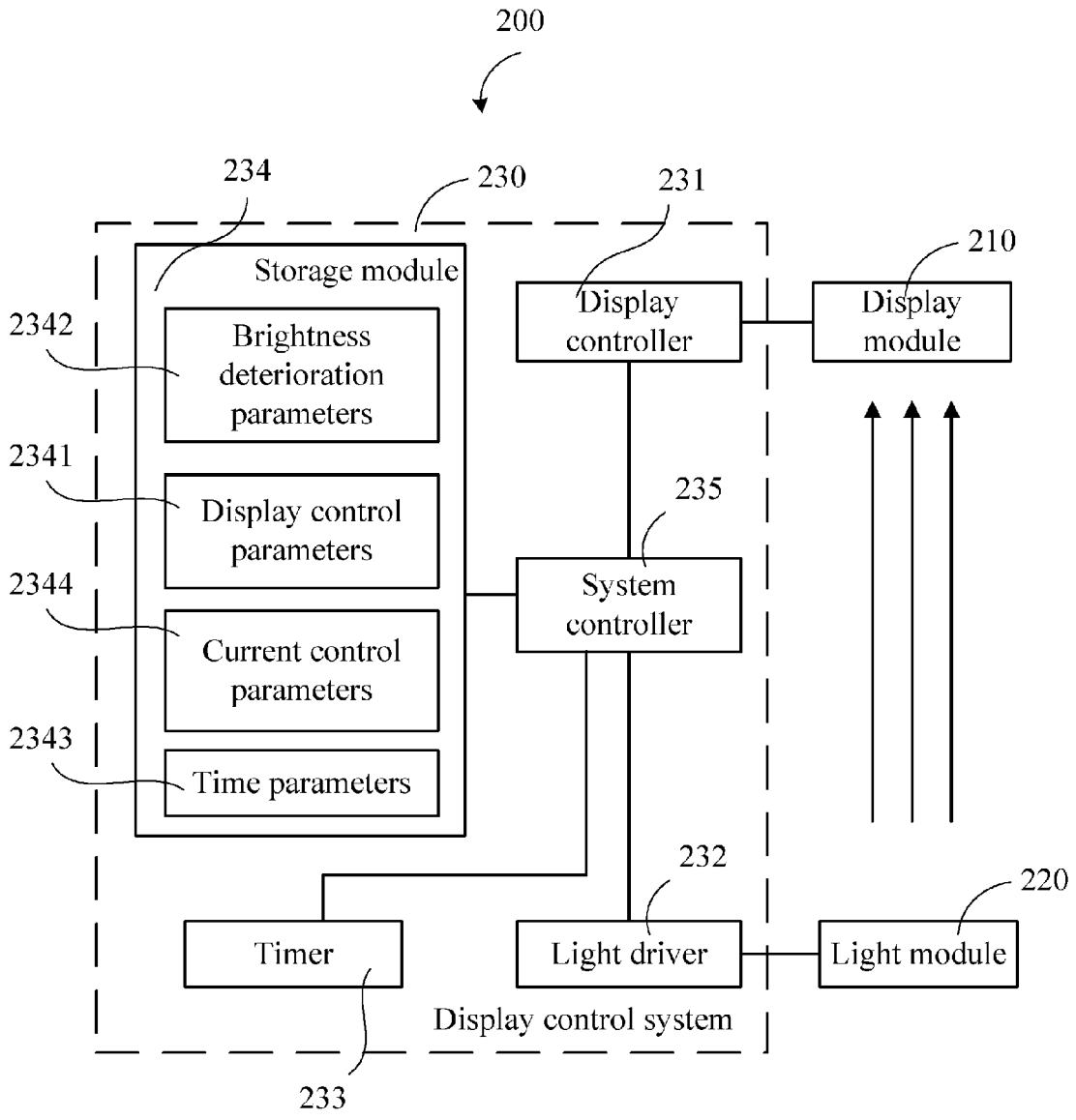
FIG. 3 is a block diagram showing an electronic display device in accordance with a second exemplary embodiment.

Referring to FIG. 3, a second electronic display device (display device in short) 200 in accordance with a second exemplary embodiment is shown. The second display device 200 has similar configurations with the first display device 100. When compared with the first display device 100, the storage module 234 may further have a fourth unit 2344 for storing current control parameters used for adjusting the operation current of the light module 220. The time parameters stored in the third unit 2343 include time points used for indicating the system controller 235 to control the light driver 232 to adjust the operation current of the light module 220, and for indicating the system controller 235 to control the display controller 231 to set the display module 210 by using corresponding display control parameters.

In practice, the system controller 235 controls the light driver 232 to decrease the operation current in a step manner (that is the operation current drops in a very short time), when the operation time reaches a second predetermined time point. The second predetermined time point may equal to or be earlier than the time point at which the brightness of the light module 220 starts to decay. The system controller 235 further controls the display controller 231 to reset the display module 210 by using the display control parameters corresponding to the decreased operation current when the operation time reaches the second predetermined time point, so as to maintain a stable display property. As stated above, the higher the operation current of the light module 220 is, the shorter the service life. Thus by doing so, the service life of the light module 220 is extended.

Hereinafter, a display control parameter setting process of the second display device 200 will be described in detail.

Figure 4:
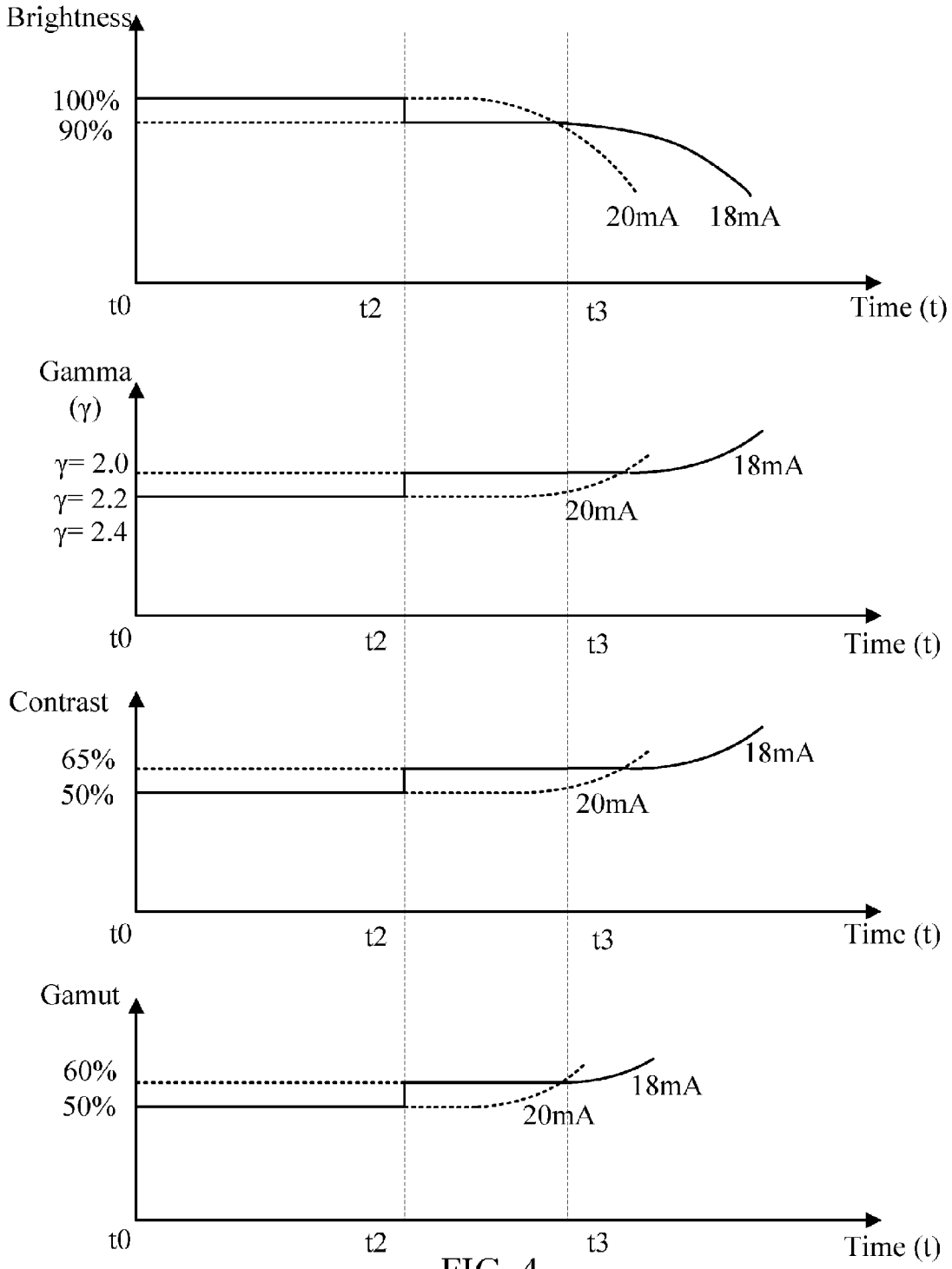
FIG. 4 is a graphical plot showing brightness parameters, gamma parameters, luminance contrasts parameters, color gamut parameters, of the display device of FIG. 3, as functions of operation time, under different current levels in accordance with a second exemplary embodiment.

Referring to FIG. 4, the system controller 235 firstly determines the operation current of the light module 220, by detecting/reading an output current of the light driver 232 for example. The operation current may be set by the users, or assigned default values. Supposing the operation current is 20 mA, a normal brightness is 100%, and original values of the display control parameters are assigned default values: the gamma is 2.2, the contrast is 50%, and the gamut is 50%.

The system controller 235 receives operation time of the light module 220 from the timer 233, and determines whether the operation time has reached the time point t2. In detail, as illustrated in FIG. 4, in response to the determination that the operation time has reached the time point t2, the system controller 235 controls the light driver 232 to decrease the operation current from 20 mA to 18 mA in a step manner, and controls the display controller 231 to adjust the gamma from 2.2 to 2.0, the contrast from 50% to 65%, and the gamut from 50% to 60% also in a step manner. Thus, maintaining/achieving a stable display property of the display module 210. It is clear from FIG. 4, the brightness of the light module 220 under 18 mA starts to decay at time point t3, while the gamut starts to increase from the time point t3, and the gamma and the contrast start to change a period of time after the time point t3, so as to maintain a stable display property.

Figure 5:
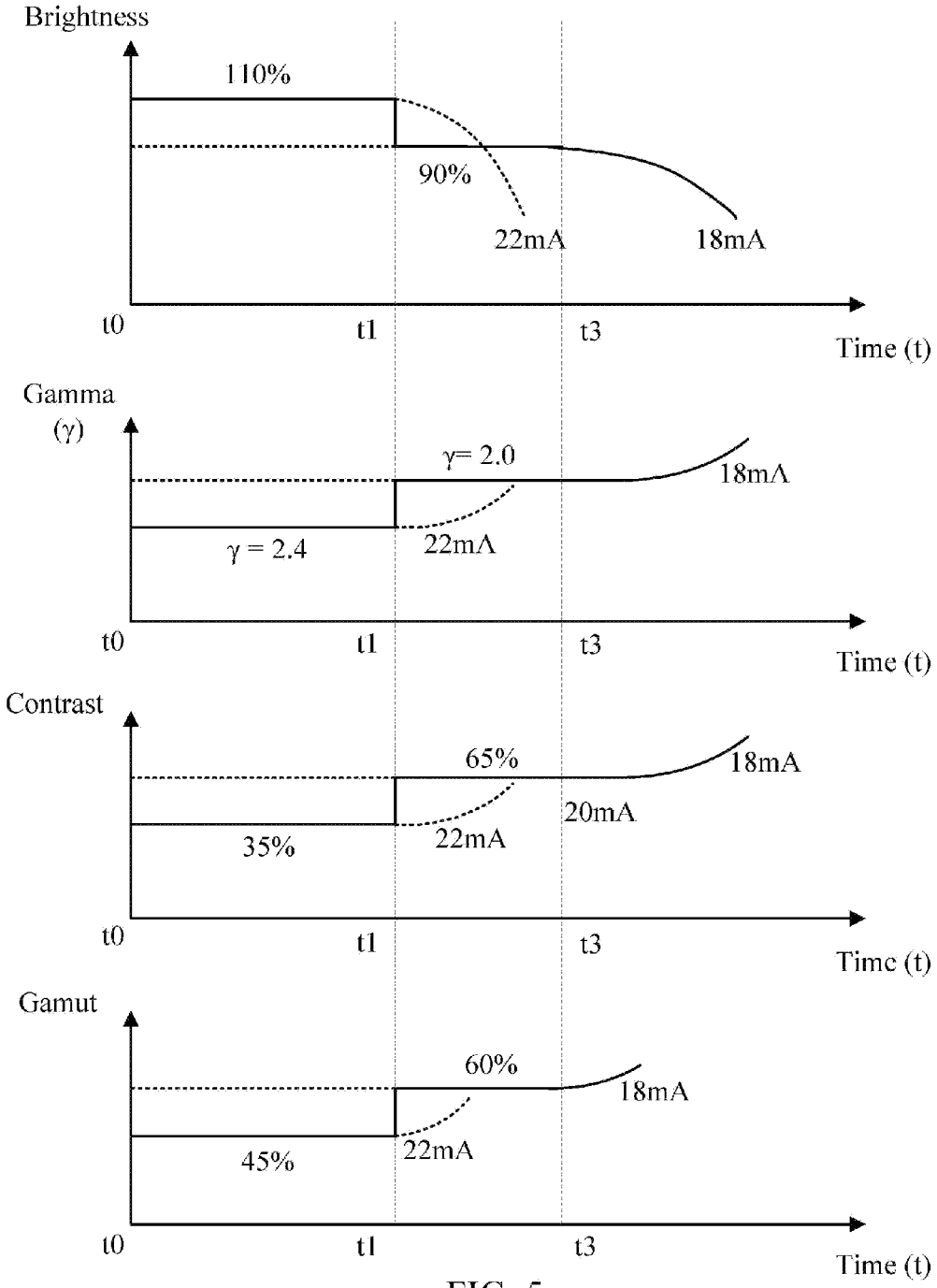
FIG. 5 is a graphical plot showing brightness parameters, gamma parameters, luminance contrasts parameters, color gamut parameters, of the display device of FIG. 3, as functions of operation time, under different current levels in accordance with a third exemplary embodiment.

In a third embodiment, as illustrated in FIG. 5, supposing the operation current is 22 mA, the normal brightness is 110%, and original values of the display control parameters are: the gamma is 2.4, the contrast is 35%, and the gamut is 45%. The system controller 235 determines whether the operation time has reached the time point t1. In detail, when the system controller 235 determines that the operation time has reached the time point t1, the system controller 235 controls the light driver 232 to decrease the operation current from 22 mA to 18 mA, and controls the display controller 231 to adjust the gamma from 2.4 to 2.0, the contrast from 35% to 65%, and the gamut from 45% to 60% to maintain a stable display property. As described above, the brightness of the light module 220 under 18 mA starts to decay at time point t3, while the gamut starts to increase from the time point t3, and the gamma and the contrast start to change a period of time after the time point t3, thus a stable display property is maintained.

In other embodiment, the display control parameters may also be set by the users, and the system controller 235 needs to determine the current display control parameters besides the operation current, by checking or requesting the display controller 231 for example. When the operation time reaches the second predetermined value, the system controller 235 controls the display controller 231 to reset the current display control parameters regularly in accordance with a predetermined rule similarly to that in the second embodiment. In doing so, the resetting of the display control parameters is more acceptable and friendly to the users.

Figure 6:
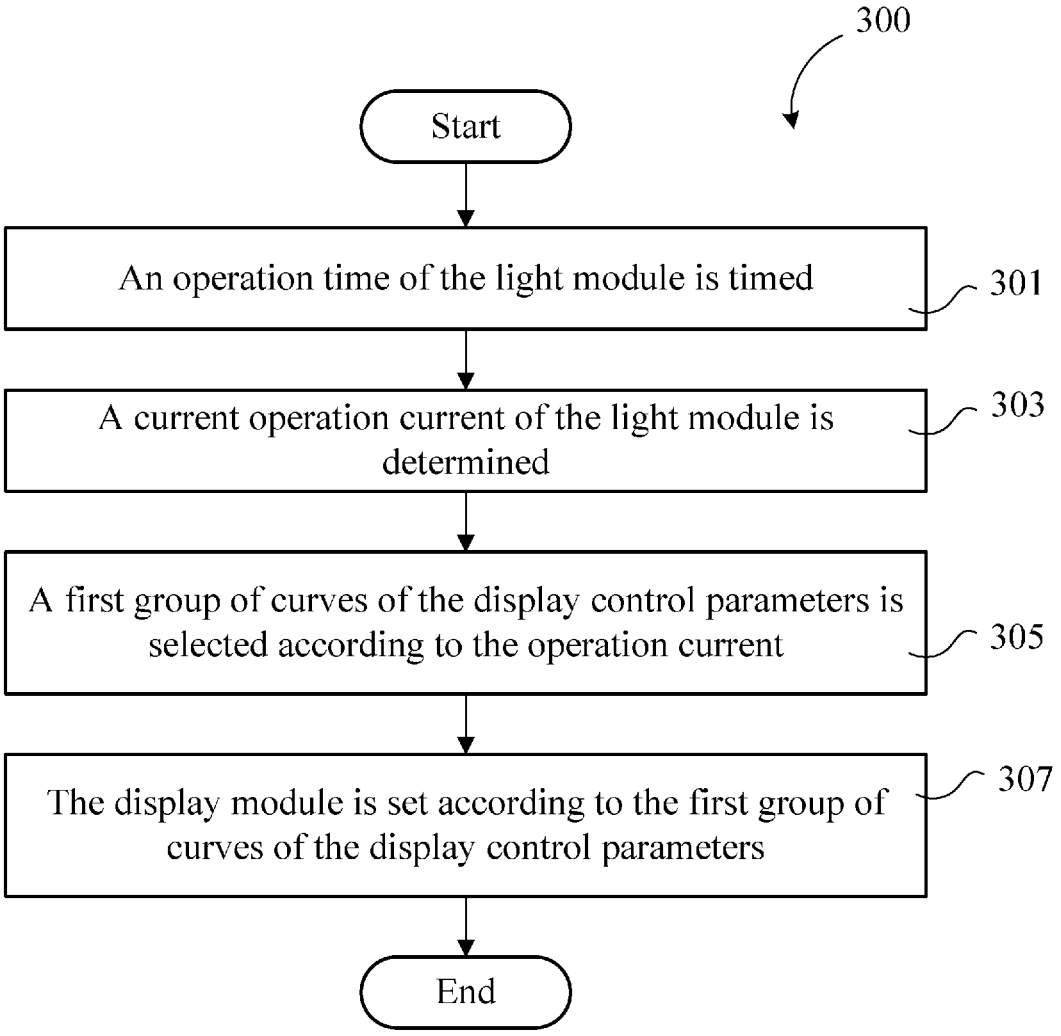
FIG. 6 is a flow chart of a display control method in accordance with a first exemplary embodiment.

Referring to FIG. 6, a flow chart of a display control method 300 for a display device in accordance with a first embodiment is illustrated. The display control method 300 is to maintain a stable display property when brightness of the display device decays. The display device may be a television (TV) set, or a computer monitor. Similar to the first and second display devices 100 and 200, the display device may include a display module, a light module, and a display control system. The light module may have a plurality of operation current levels, and a plurality of brightness respectively corresponding to the operation current levels. The operation currents may be 18 milliamperes (mA), 20 mA, and 22 mA. Brightness of the light module, corresponding to the operation current levels of 18 mA, 20 mA, and 22 mA, are considered as 90%, 100%, and 110% before decaying.

The display control system may include a storage module storing display control parameters. The display control parameters may include gamma, luminance contrast (contrast in short), and color gamut (gamut in short), all as functions of operation time of the light module. The display control parameters may be depicted as curves of gamma, contrast and gamut, as functions of time (namely, the operation time), as shown in FIG. 2. Corresponding to different operation current levels, the display control parameters may be divided into respective groups.

The display control method 300 may include the following steps. The various actions in the display control method 300 may be performed in the order presented, or may be performed in a different order. Furthermore, in some embodiments, some actions listed in FIG. 6 may be omitted from the display control method 300.

In step 301, an operation time of the light module is measured/tracked by a timer. The operation time refers to an accumulative total operation time of the light module.

In step 303, an operation current of the light module is determined. The operation current may be set by users, or assigned default values. Supposing the operation current is 22 mA, thus the normal brightness is 110%.

In step 305, a first group of curves of the display control parameters is selected according to the operation current. In this embodiment, as the operation current is 22 mA, curves of the display control parameters with original values: the gamma of 2.4, the contrast of 35%, and the gamut of 45% are selected.

In step 307, the display module is set according to the first group of curves of the display control parameters. In detail, the gamut is increased after the operation time reaches a first predetermined time point at which the brightness of the light module starts to decay, while the contrast is increased and the gamma is decreased a period of time after the first predetermined time point to compensate for the brightness deterioration. As a result, a display property of the display module could be maintained stably. In another perspective, the service life of the light module is extended.

In other embodiments, the first predetermined time point is stored for indicating the display device to reset the display module.

Figure 7:
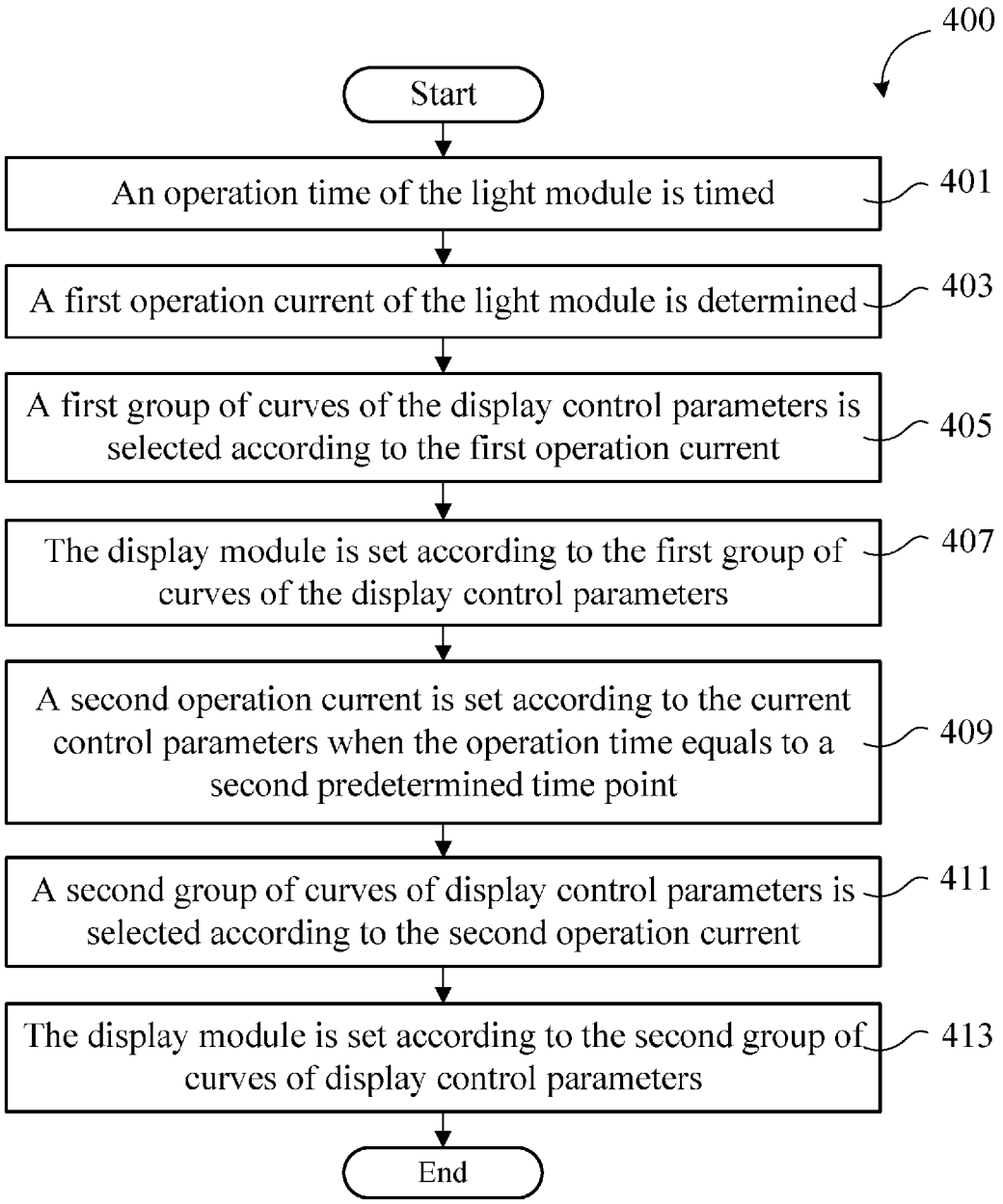
FIG. 7 is a flow chart of a display control method in accordance with a second exemplary embodiment.

Referring to FIG. 7, a flow chart of a display control method 400 for maintaining a stable display property when brightness of a display device decays in accordance with a second embodiment is illustrated. When compared with the display control method 300, the display device further stores current control parameters, and the display control method 400 further reset the operation current of the light module according to the current control parameters.

The display control method 400 may include the following steps. The various actions in the display control method 400 may be performed in the order presented, or may be performed in a different order. Furthermore, in some embodiments, some actions listed in FIG. 7 may be omitted from the display control method 400.

In step 401, an operation time of the light module is measured/tracked by a timer. The operation time means an accumulative total operation time of the light module.

In step 403, a first operation current (that is, the instant current) of the light module is determined. The first operation current may be set by users, or assigned default values. Referring also to FIG. 4, supposing the first operation current is 20 mA, thus the normal brightness is 100%.

In step 405, a first group of curves of the display control parameters is selected according to the first operation current. In this embodiment, as the first operation current is 20 mA, curves of the display control parameters with original values: the gamma of 2.2, the contrast of 50%, and the gamut of 50% are selected.

In step 407, the display module is set according to the first group of curves of the display control parameters.

In step 409, a second operation current is set according to the current control parameters when the operation time equals to a second predetermined time point. The second predetermined time point equals to or earlier than the time point at which the brightness of the light module decays. The second operation current is lower than the first operation current. In this embodiment, the second operation current is 18 mA. As stated above, the lower the operation current of the light module is, the longer the service life. Thus by doing so, the service life of the light module is extended when in another perspective.

In step 411, a second group of curves of display control parameters is selected according to the second operation current. In this embodiment, as the second operation current is 18 mA, the second group of curves of the display control parameters with original values: the gamma of 2.0, the contrast of 65%, and the gamut of 60% are selected.

In step 413, the display module is set according to the second group of curves of display control parameters. In detail, the gamut is increased after the operation time reaches the third predetermined time point at which the brightness of the light module starts to decay, while the contrast is increased and the gamma is decreased to compensate for the brightness deterioration a period of time after the third predetermined time point. As a result, a display property of the display module could be maintained stably. In another perspective, the service life of the light module is extended.

In other embodiments, the second and third predetermined time points are stored for indicating the display device to set the display module.

It is to be further understood that even though numerous characteristics and advantages of the present embodiments have been set forth in the foregoing description, together with details of the structures and functions of the embodiments, the disclosure is illustrative only; and changes may be made in detail, especially in matters of shape, size, and arrangement of parts within the principles of the present disclosure to the full extent indicated by the broad general meaning of the terms in which the appended claims are expressed.

What is claimed is:

1. A display device, comprising:

a display module for displaying information;

a light module for emitting light to the display module; and a display control system comprising:

a storage module for storing display control parameters; and a system controller for determining whether the operation time of the light module which is an accumulative total time representing how long the light module has serviced equals to a predetermined time point, and setting the display module by changing the display control parameters retrieved from the storage module, in response to the determination that the operation time of the light module equals to the predetermined time point;

wherein the display control parameters comprise gamma parameters, luminance contrast parameters, and color gamut parameters, all as functions of the operation time; the light module comprises a plurality of operation current levels, the display control parameters are divided into a plurality of groups, each of the plurality of groups corresponds to an operation current level of the light module.

2. The display device of claim 1, wherein a brightness of the light module starts to decay at the predetermined time point; values of the color gamut parameters increase after the operation time reaches the predetermined time point, values of the gamma parameters decrease a period of time after the predetermined time point, and values of the luminance contrast parameters increase a period of time after the predetermined time point to compensate for a brightness deterioration of the light module.

3. The display device of claim 1, wherein one of the operation current levels is 20 milliamperes (mA), a group of the display control parameters, corresponding to the 20mA operation current level, comprises a gamma with an original value of 2.2, a luminance contrast with an original value of 50%, and a color gamut with an original value of 50%.

4. The display device of claim 1, wherein one of the operation current levels is 18mA, a group of the display control parameters, corresponding to the 18mA operation current level, comprises a gamma with an original value of 2.0, a luminance contrast with an original value of 65%, and a color gamut with an original value of 60%.

5. The display device of claim 1, wherein one of the operation current levels is 22mA, a group of the display control parameters, corresponding to the 22mA operation current level, comprises a gamma with an original value of 2.4, a luminance contrast with an original value of 35%, and a color gamut with an original value of 45%.

6. The display device of claim 1, wherein the storage module further stores current control parameters and time parameters comprising time points to indicate the system controller to adjust an operation current of the light module according to the current control parameters.

7. The display device of claim 6, wherein the system controller adjusts the display control parameters according to the adjusted operation current.

8. The display device of claim 6, wherein the display control system further comprises a light driver for powering the light module, the system controller adjusts the operation current via the light driver.

9. The display device of claim 1, wherein the storage module further stores brightness deterioration parameters, as a function of the operation time, for indicating brightness of the light module.

10. The display device of claim 1, wherein the display control system further comprises a timer for measuring the operation time.

11. The display device of claim 1, wherein the storage module further stores time parameters for indicating the system controller time points to set the display module using the display control parameters.

12. The display device of claim 1, wherein the display control system further comprises a display controller for controlling operations of the display module, the system controller sets the display module via the display controller.

13. A display control method for a display device having a light module and a display module, the display control method comprising:

determining a first operation current of the light module;

selecting a first group of display control parameters according to the first operation current; and setting the display module according to the first group of display control parameters;

determining whether the light module has been operated for a predetermined value;

setting the light module with a second operation current in response to the determination that the operation time equals to a predetermined value;

selecting a second group of display control parameters according to the second operation current; and setting the display module according to the second group of display control parameters;

wherein the display control parameters configured for compensating a brightness deterioration of the light module are functions of operation time of the light module.

14. The display control method of claim 13, wherein the first group of display control parameters comprise gamma parameters, luminance contrast parameters, and color gamut parameters.

15. The display control method of claim 13, wherein a brightness of the light module starts to decay after the operation time reaches a first predetermined operation time, and values of the first group of display control parameters are unchanged within the first predetermined operation time, and changes after the first predetermined operation time to compensate for a brightness deterioration.

16. The display control method of claim 13, wherein the second operation current is lower than the first operation current.

* * * * *